US008678516B2

(12) United States Patent
Fader et al.

(10) Patent No.: US 8,678,516 B2
(45) Date of Patent: Mar. 25, 2014

(54) POLYGONAL SHIELD WASHER

(75) Inventors: Joseph Fader, Graz (AT); Kenneth Monyak, Abingdon, VA (US); Daniel Mouthaan, Williamsburg, MI (US)

(73) Assignee: Sandvik Intellectual Property AB, Sandviken (SE)

( * ) Notice: Subject to any disclaimer, the term of this patent is extended or adjusted under 35 U.S.C. 154(b) by 198 days.

(21) Appl. No.: 13/404,330

(22) Filed: Feb. 24, 2012

(65) Prior Publication Data

US 2013/0057046 A1 Mar. 7, 2013

Related U.S. Application Data

(60) Provisional application No. 61/449,111, filed on Mar. 4, 2011.

(51) Int. Cl.
*E21C 35/183* (2006.01)

(52) U.S. Cl.
USPC ..... 299/104

(58) Field of Classification Search
USPC ..... 299/104; 411/531, 533
See application file for complete search history.

(56) References Cited

U.S. PATENT DOCUMENTS

| | | | | | |
|---|---|---|---|---|---|
| 3,190,334 | A | * | 6/1965 | Wigam | 411/131 |
| 3,406,731 | A | * | 10/1968 | Terry | 411/197 |
| 4,489,986 | A | | 12/1984 | Dziak | |
| 6,508,516 | B1 | | 1/2003 | Kammerer | |
| 6,644,755 | B1 | | 11/2003 | Kammerer | |
| 2005/0082899 | A1 | | 4/2005 | Levankovsky | |

FOREIGN PATENT DOCUMENTS

| | | | |
|---|---|---|---|
| DE | 199 22 206 | | 11/2000 |
| DE | 101 10 015 | A1 | 10/2002 |
| EP | 0 639 437 | | 2/1995 |
| WO | 03/042500 | | 5/2003 |
| WO | WO 2009/139691 | A1 | 11/2009 |
| WO | WO 2009/142578 | A1 | 11/2009 |

OTHER PUBLICATIONS

Office Action for German Patent Application No. 10 2012 101 732.8, dated Jul. 4, 2013.

* cited by examiner

*Primary Examiner* — John Kreck
(74) *Attorney, Agent, or Firm* — Morgan, Lewis & Bockius LLP

(57) ABSTRACT

A polygonal shaped shield washer for mounting on a pick holder having a mating polygonal shaped barrel, the washer including a top having an interior opening and outer periphery defined by plurality of edges, each pair of adjacent edges being joined at a corner, and a skirt extending rearwardly from the outer periphery of the top, the skirt having a plurality of edges and corners aligned with the edges and corners of the top.

12 Claims, 3 Drawing Sheets

POLYGONAL SHIELD WASHER

RELATED APPLICATION DATA

This application claims priority under 35 U.S.C. §119(e) to U.S. Provisional Application No. 61/449,111, filed Mar. 4, 2011, entitled "Polygonal Shield Washer", the entire contents of which are incorporated herein by reference.

FIELD

The present disclosure relates to a shield washer for protecting the top portion of a tool pick holder system, and in particular to a shield washer having a polygonal shape matching the shape of a barrel of a pick holder for reducing wear on the pick holder, as well as on a sleeve used to retain the tool pick in the pick holder.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Grinding and milling machines typically include several pick holders mounted on a rotating drum. The pick holders are removable from the drum for maintenance or replacement. Each pick holder holds a rotatable tool pick that rotates within the pick holder during operation. The pick holder has a bore for receiving a shank of the tool pick and a barrel at its frontward end on which a shoulder of the tool pick may be seated. A common type of pick holder includes a polygonal-shaped (e.g., hexagonal) barrel to facilitate installation and removal of a pick. Each tool pick has a tip portion that contacts the surface of material that is to be ground or milled. To maximize the working life of the tip portion, and thus of the tool pick, the shank of the tool pick is able to rotate within the bore of the pick holder, so that the tip portion of the tool pick wears substantially uniformly.

During operation of the machine, debris such as fines, dust, grit, pebbles, dirt, and the like, may work its way between the shoulder of the tool pick and the barrel of the pick holder, abrading the barrel of the pick holder. While the tool pick is readily replaceable and needs periodic replacement due to wear of the tip portion, it is preferable not to have to replace the pick holder frequently. Because debris can also cause the pick holder to itself become lodged in the drum, a polygonal shaped barrel may be provided at the forward end of the pick holder to enable use of a wrench or other tool to rotate and dislodge the pick holder from the drum.

The debris may also get into an annular gap between the bore of the pick holder and the shank of the tool pick, impeding rotation of the tool pick, which reduces the wear life of the tip portion of the tool pick. Therefore, to protect the barrel of the pick holder and to help preserve the ability of the tool pick to rotate during operation, there is a need for a mechanism to prevent or reduce frictional wear from debris on the barrel of the pick holder, and to prevent or inhibit debris from reaching the annular gap between the shank of the tool pick and the bore of the pick holder.

SUMMARY

An exemplary embodiment of a polygonal shaped shield washer for mounting on a pick holder having a mating polygonal shaped barrel includes a top and a skirt. The top has an interior opening and outer periphery defined by plurality of edges, each pair of adjacent edges being joined at a corner. The skirt extends rearwardly from the outer periphery of the top and has a plurality of edges and corners aligned with the edges and corners of the top.

An exemplary embodiment of a pick assembly for mounting in a pick holder having a polygonal shaped barrel includes a tool pick and a polygonal shaped shield washer. The tool pick has a shoulder, a cutting tip extending frontwardly with respect to the shoulder, and a shank extend rearwardly with respect to the shoulder. The polygonal shaped shield washer is located rearwardly adjacent to the shoulder of the tool pick, the washer including a top having an interior opening and outer periphery defined by plurality of edges, each pair of adjacent edges being joined at a corner. The washer includes a skirt extending rearwardly from the outer periphery of the top, the skirt having a plurality of edges and corners aligned with the edges and corners of the top.

An exemplary embodiment of a pick and holder assembly includes a pick holder, a tool pick, and a polygonal shaped shield washer. The pick holder has a bore therethrough and a polygonal shaped barrel at a frontward end. The tool pick has a shoulder, a cutting tip extending frontwardly with respect to the shoulder, and a shank extend rearwardly with respect to the shoulder. The polygonal shaped shield washer is shaped for mating with the polygonal shaped barrel of the pick holder. The washer is located rearwardly adjacent to the shoulder of the tool pick. The washer includes a top having an interior opening and outer periphery defined by plurality of edges, each pair of adjacent edges being joined at a corner, and a skirt extending rearwardly from the outer periphery of the top, the skirt having a plurality of edges and corners aligned with the edges and corners of the top. The washer fits over a frontward portion of the barrel of the pick holder.

An exemplary embodiment of a grinding or milling machine includes a rotatable member and one or more pick and holder assemblies mounted on the rotatable member. Each pick and holder assembly includes a pick holder, a tool pick, and a polygonal shaped shield washer. The pick holder has a bore therethrough and a polygonal shaped barrel at a frontward end. The tool pick has a shoulder, a cutting tip extending frontwardly with respect to the shoulder, and a shank extend rearwardly with respect to the shoulder.

The polygonal shaped shield washer is shaped for mating with the polygonal shaped barrel of the pick holder. The washer is located rearwardly adjacent to the shoulder of the tool pick. The washer includes a top having an interior opening and outer periphery defined by plurality of edges, each pair of adjacent edges being joined at a corner, and a skirt extending rearwardly from the outer periphery of the top, the skirt having a plurality of edges and corners aligned with the edges and corners of the top. The washer fits over a frontward portion of the barrel of the pick holder.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1:
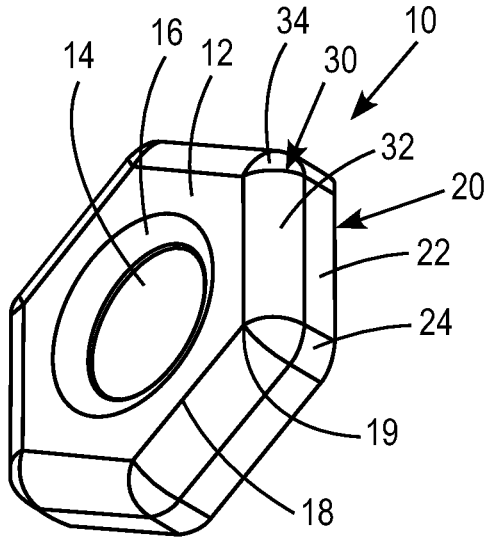
FIG. 1 is a top perspective view of an embodiment of a shield washer for a tool pick.
Figure 2:
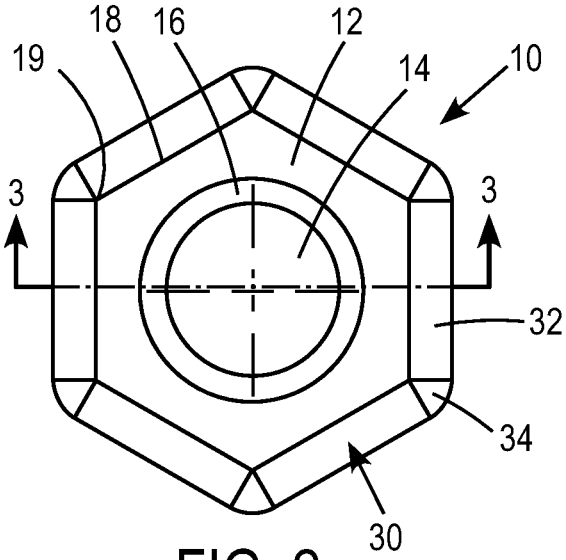
FIG. 2 is a top view of an embodiment of a shield washer as in FIG. 1.
Figure 3:
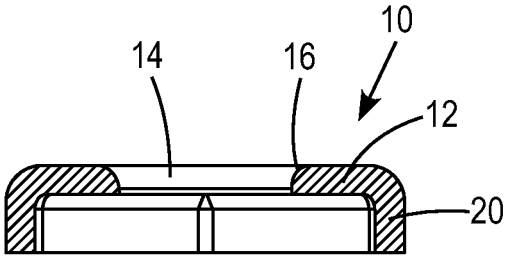
FIG. 3 is a cross-sectional view of an embodiment of a shield washer taken along line 3-3 in FIG. 2.

FIGS. 1-3 illustrate an embodiment of a polygonal shield washer 10 having a top 12 and a skirt 20 extending rearwardly from an outer periphery of the top 12. In the depicted embodiment, the shield washer 10 has a regular hexagonal shape with six substantially equal length sides, it being understood that the shield washer 10 can have any number of sides of equal or different lengths which corresponding to a barrel of a pick holder having the same shape as determined by the number of sides and the length of each side.

Figure 4:
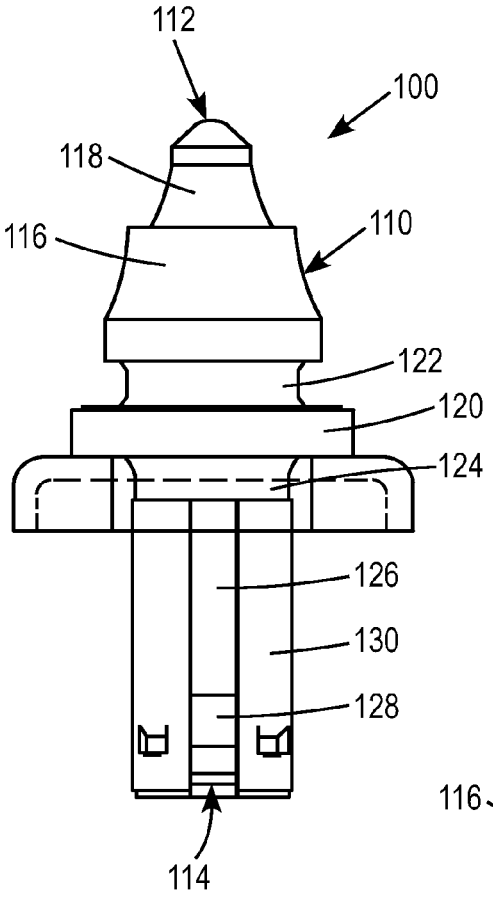
FIG. 4 is a side elevation view of an embodiment of a shield washer as in FIG. 1 installed on a tool pick.

The shield washer 10 is shaped to receive a tool pick 110 to form a tool pick assembly 100, as shown in FIG. 4. The tool pick assembly 10 can be installed into a pick holder 210 to form a pick and holder assembly 200 in which the shield washer 10 is held between the tool pick 110 and the pick holder 210.

Figure 6:
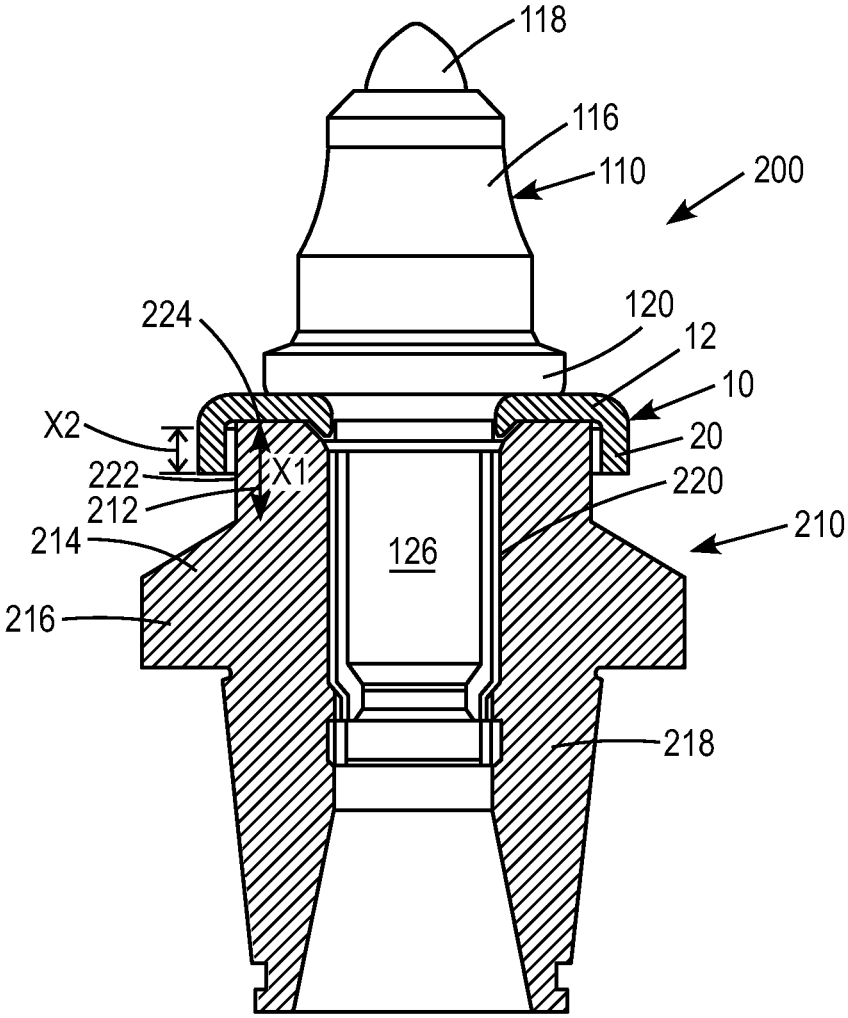
FIG. 6 is a side cross-sectional view of an embodiment of a shield washer as in FIG. 1 installed on a tool pick mounted in a pick holder.

The shield washer 10 can be used with any conventional tool pick 110, which typically spans from a front end 112 and a rear end 114. The tool pick 110 includes a tapered head portion 116, a cutting tip 118 projecting frontwardly from the head portion 116, and a shoulder 120 extending rearwardly with respect to the head portion 116. A reduced diameter puller groove 122 may be provided rearwardly adjacent to the head portion 116 and frontwardly adjacent to the shoulder 120 to facilitate removal of the tool pick 110 form a holder. Projecting rearwardly form the shoulder 120 is a shank 126 having a diameter sized to be received in a bore in a pick holder 210, as shown in FIG. 6. A tapered portion of the shank 126 immediately adjacent to the shoulder 122 may have a diameter slightly larger than that of the shank 126 to serve as a washer seat 124. The shank 126 may include a retaining groove 128 for engaging with a spring retainer sleeve 130 that retains the tool pick 110 in a bore of the pick holder 210.

Figure 5:
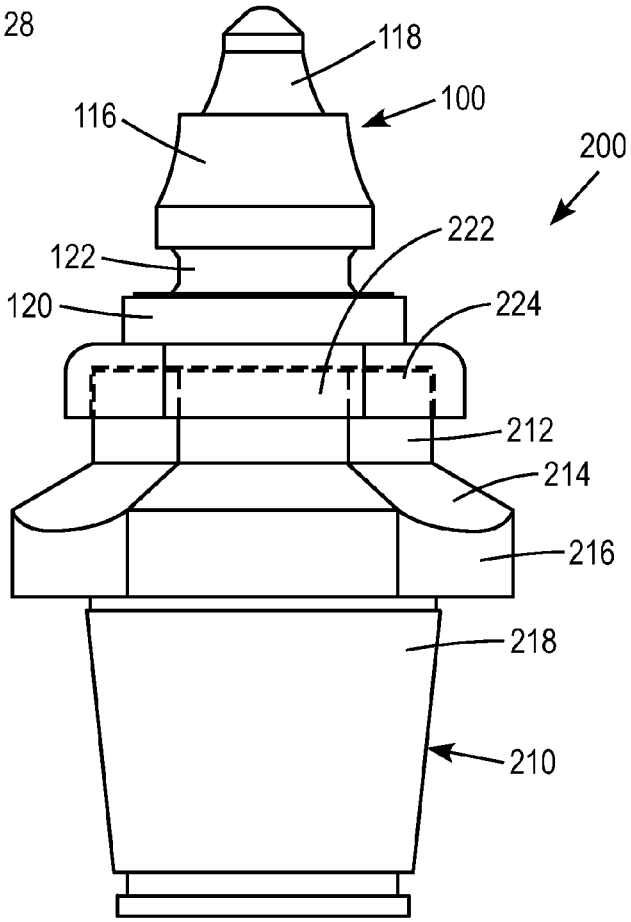
FIG. 5 is a side elevation view of an embodiment of a shield washer as in FIG. 1 installed on a tool pick mounted in a pick holder.

As shown in FIGS. 5 and 6, the pick holder 210 includes a body 218 adapted to be received into a rotating drum of a grinding or milling machine. The body 218 extends rearwardly from a shoulder 216 that rests on a surface of the drum of a grinding or milling machine when the pick holder 210 is installed. A barrel 212 projects frontwardly with respect to the shoulder 216, the barrel 212 being narrower than the shoulder 216. A transition portion 214 joins the barrel 212 to the shoulder 216. A generally cylindrical bore 220 extends through the length of the pick holder 210, i.e., through the barrel 212, the transition portion 214, the shoulder 216, and the body 218.

The barrel 212 has a front surface 224 and side surfaces 222. The side surfaces 222 extend a distance of X1 from the front surface 224 to a junction of the barrel 212 with the transition portion 214. In the absence of a shield washer or other mechanism to protect the barrel 212, the front surface 224 and the side surfaces 222 of the barrel 212 are exposed and may be rapidly eroded by debris that is shed from the cutting tip 118 of the tool pick 110.

To facilitate removal of the pick holder 210 from a drum of a machine, the barrel 212 and the shoulder 216 may include one or more flats adapted to receive a wrench or other tool. In the embodiment depicted in FIG. 5, the barrel 212, shoulder 216, and transition portion 214 each have a regular hexagonal shape with six substantially equal length sides.

A pick and holder assembly 200 includes a pick holder 210, a tool pick 110 mounted in the pick holder 210, and a shield washer 10 located between the barrel 212 of the pick holder 210 and the shoulder 116 of the tool pick 110. The top 12 of the shield washer 10 includes a substantially circular opening 14 centrally located in the top 12 and having a diameter at least as large as the diameter of the shank 126 and/or the washer seat 124 of the tool pick 110. A chamfered portion 16 may be sloped rearwardly from the top 12 toward the opening 14, the chamfer being shaped to correspond to the junction between the washer seat 124 and the shoulder 120 of the tool pick 110.

The top 12 is bounded by a plurality of straight edges 18, with each adjacent pair of edges 18 being joined at a corner 19. The edges 18 and the corners 19 define an outer periphery of the top 12. In the embodiment depicted in FIGS. 1-3, the top 12 has six substantially equal length edges 18 and six corners 19. The skirt 20 depends rearwardly from the top 12 and has a plurality of straight sides 22, with each pair of adjacent sides 22 being joined at a corner 24. The sides 22 of the skirt 20 are aligned with the edges 18 of the top, and the corners 24 of the skirt are aligned with the corners 19 of the top 12. To provide a smooth transition between the top 12 and the skirt 20, a transition portion 30 may be provided having a plurality of curved sides 32, with each pair of adjacent sides 32 being joined at a corner 34. The sides 32 of the transition portion 30 are aligned with the sides 22 and the edges 18 of the skirt 20 and the top 12, respectively, and the corners 34 of the transition portion 30 are aligned with the corners 24 and 19 of the skirt 20 and top 12, respectively.

The shield washer 10 protects the front surface 224 and the side surfaces 222 of the barrel 212 of the pick holder 210 from debris without inhibiting rotation of the tool pick 110 during operation. Because the shield washer 10 has a shape that matches the shape of the barrel 212 of the pick holder 210, the shield washer 10 remains nonrotating with respect to the pick holder 210 even as the tool pick 110 rotates within the bore 220 of the pick holder 210 and the opening 14 of the washer 10.

When the shield washer 10 is installed between the shoulder 120 of the tool pick 110 and the barrel 212 of the pick holder 210, the top 12 rests on the front surface 224 of the barrel 212 and the skirt 20 extends rearwardly adjacent to the sides surfaces 222 of the barrel 212 by a distance X2. The distance X2 is less than or equal to the distance X1 defining the depth of the side surfaces 222 of the barrel 212. Preferably, the distance X2 is at least about 25% of the distance X1 so as to protect a frontward portion of the side surfaces 222. In addition, a distance X2 of at least about 25% of the distance X1 provides a sufficient amount of skirt 20 to engage the barrel 212 that the washer 10 is prevented from rotating with respect to the pick holder 210.

As fines and debris impact the tool pick 110 during operation, the shield washer 10 protects the portion of the pick holder 210 rearward of the tool pick 110 by deflecting the fines and debris away. This dramatically reduces the erosion of portions of the pick holder 210 that are not even directly covered by the shield washer 10, including the transition portion 214 and the shoulder 216.

The skirt 20 of the shield washer 10, in addition to directly protecting the side surfaces 222 of the barrel 212 from debris and abrasive fines, also protects the front surface 224 of the barrel 212 by preventing debris and fines from working their way in between the washer 10 and the barrel 212. Without the skirt 20 (e.g., using a flat washer resting on the frontward surface of the barrel), it would be more likely that fines and debris could come between the top 12 of the washer 10 and the front surface 224 of the barrel 212. In addition, because the skirt 20 prevents rotation of the washer 10 with respect to the pick holder 212, any fines and debris that do make their way into the space between the top 12 of the washer 10 and the front surface 224 of the barrel 212 will not cause significant frictional wear on the front surface 224 of the barrel.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A mining machine, comprising:

a rotatable member; and one or more pick and holder assemblies mounted on the rotatable member, each pick and holder assembly comprising:

a pick holder having a bore therethrough and a polygonal shaped barrel at a frontward end;

a tool pick having a shoulder, a cutting tip extending frontwardly with respect to the shoulder, and a shank extend rearwardly with respect to the shoulder; and a polygonal shaped shield washer mating with the polygonal shaped barrel of the pick holder, the washer being located rearwardly adjacent to the shoulder of the tool pick, the washer including a top having an interior opening and outer periphery defined by plurality of edges, each pair of adjacent edges being joined at a corner, the washer further including a skirt extending rearwardly from the outer periphery of the top, the skirt having a plurality of edges and corners aligned with the edges and corners of the top.

2. The mining machine of claim 1, wherein the polygonal shape is a regular hexagon such that the top and the skirt each have six substantially equal length sides.

3. The mining machine of claim 1, further comprising a curved edge transition portion connecting each edge of the top to the corresponding edge of the skirt, and a curved corner transition portion connecting each corner of the top to the corresponding corner of the skirt.

4. The mining machine of claim 1, further comprising a rearwardly beveled surface extending from the top and surrounding the interior opening.

5. A pick assembly for mounting in a pick holder having a polygonal shaped barrel, the pick assembly comprising:

a tool pick having a shoulder, a cutting tip extending frontwardly with respect to the shoulder, and a shank extend rearwardly with respect to the shoulder; and a polygonal shaped shield washer rearwardly adjacent to the shoulder of the tool pick, the washer including a top having an interior opening and outer periphery defined by plurality of edges, each pair of adjacent edges being joined at a corner, the washer further including a skirt extending rearwardly from the outer periphery of the top, the skirt having a plurality of edges and corners aligned with the edges and corners of the top.

6. The pick assembly of claim 5, wherein the polygonal shape is a regular hexagon such that the top and the skirt each have six substantially equal length sides.

7. The pick assembly of claim 5, further comprising a curved edge transition portion connecting each edge of the top to the corresponding edge of the skirt, and a curved corner transition portion connecting each corner of the top to the corresponding corner of the skirt.

8. The pick assembly of claim 5, further comprising a rearwardly beveled surface extending from the top and surrounding the interior opening.

9. A pick and holder assembly comprising:

a pick holder having a bore therethrough and a polygonal shaped barrel at a frontward end;

a tool pick having a shoulder, a cutting tip extending frontwardly with respect to the shoulder, and a shank extend rearwardly with respect to the shoulder; and a polygonal shaped shield washer mating with the polygonal shaped barrel of the pick holder, the washer being located rearwardly adjacent to the shoulder of the tool pick, the washer including a top having an interior opening and outer periphery defined by plurality of edges, each pair of adjacent edges being joined at a corner, the washer further including a skirt extending rearwardly from the outer periphery of the top, the skirt having a plurality of edges and corners aligned with the edges and corners of the top.

10. The pick and holder assembly of claim 9, wherein the polygonal shape is a regular hexagon such that the top and the skirt each have six substantially equal length sides.

11. The pick and holder assembly of claim 9, further comprising a curved edge transition portion connecting each edge of the top to the corresponding edge of the skirt, and a curved corner transition portion connecting each corner of the top to the corresponding corner of the skirt.

12. The pick and holder assembly of claim 9, further comprising a rearwardly beveled surface extending from the top and surrounding the interior opening.

* * * * *